United States Patent [19]

Crompton

[11] Patent Number: 4,662,636

[45] Date of Patent: May 5, 1987

[54] AMUSEMENT MACHINE HAVING RANDOMIZED BONUS PAYOUT

[75] Inventor: Gordon J. Crompton, Burchington, England

[73] Assignee: Crompton Machine Company Limited, Kent, England

[21] Appl. No.: 793,757

[22] Filed: Nov. 1, 1985

[30] Foreign Application Priority Data

Sep. 13, 1985 [ES] Spain ..... 289016

[51] Int. Cl.[4] ..... A63F 7/02

[52] U.S. Cl. ..... 273/138 A; 273/86 C

[58] Field of Search ..... 273/86 C, 86 G, 121 B, 273/121 A, 138 R, 138 A, 109, 117, 356, 118 A, 124 A

[56] References Cited

U.S. PATENT DOCUMENTS 2,732,210 1/1956 Heide ..... 273/86 G

FOREIGN PATENT DOCUMENTS 2124913 2/1984 United Kingdom ..... 273/138 R

*Primary Examiner*—Richard C. Pinkham
*Assistant Examiner*—Mary Ann S. Lastova
*Attorney, Agent, or Firm*—McAulay, Fields, Fisher, Goldstein & Nissen

[57] ABSTRACT

An amusement machine is provided which comprises a playing field having a flat, horizontal upper surface which is adapted to support coins and a coin pusher which, in use, periodically sweeps across part of the playfield surface so as to disturb coins distributed thereon. Accordingly, some coins may be pushed over at least one edge of the playfield surface into a win chute leading to a pay cup from which coins may be recovered by the user of the machine. A coin passage is provided through which the user can introduce additional coins onto the playfield surface to increase the chance of coins being pushed over the edge. A coin conveyor conveys some of the coins introduced by the user directly from the coin passage to a location above and close to the edge of the playfield. A sensor detects the passage of a coin in the coin conveyor. An actuating device is responsive to a signal from the sensor to release a bonus payout of coins into the pay cup.

4 Claims, 3 Drawing Figures

AMUSEMENT MACHINE HAVING RANDOMIZED BONUS PAYOUT

This invention relates to an amusement machine, and more particularly to an improved machine of the "money-pusher" type.

Money-pusher machines have been known for some years. They generally include a horizontal playfield on which a large number of coins is distributed. Naturally, any discs or tokens or the like may be used instead of coins and the term "coin" in this specification is to be understood accordingly. The pattern of coins on the playfield is periodically disturbed by a money-pusher, which may be in the form of a movable stage which sweeps across part of the playfield surface. Coins are pushed towards an edge of the playfield and some may be pushed over the edge into a "win chute", from which they pass into a pay cup and may be recovered by the user of the machine. The user inserts additional coins into the machine and these may pass onto the playfield surface directly or via an upper surface of the money-pusher. The user of the machine naturally hopes that such additional coins will enable a larger number of coins to be pushed over the edge into the win chute, so that he makes a nett gain.

An object of the present invention is to provide an additional feature for such machines whereby some coins inserted by the user, selected on a random basis, will release a bonus payout of coins into the pay cup.

Thus, the present invention provides an amusement machine comprising a playfield having a flat, horizontal upper surface, adapted in use to support coins; a coin pusher which, in use, periodically sweeps across part of the playfield surface so as to disturb coins distributed thereon, whereby some coins may be pushed over at least one edge of the playfield surface into a win chute leading to a pay cup from which coins may be recovered by the user of the machine; a coin passage through which the user can introduce additional coins onto the playfield surface to increase the chance of coins being pushed over the said edge; coin conveyor means to convey some coins, introduced by the user, directly from the coin passage to a location above and close to the said edge of the playfield; means for randomly selecting coins introduced by the user to pass from the coin passage into the coin conveyor means; sensor means which detect the passage of a coin in the coin conveyor means; and actuating means which, in response to a signal from the sensor means, release a bonus payout of coins into the pay cup.

The coins introduced by the user which pass into the coin conveyor means are randomly selected. The coin conveyor means may comprise a sloping coin slide which reciprocates transversely relative to the coin pusher, so that its entry is always in communication with the coin passage and its exit is always close to the edge of the playfield. A coin inserted by the user may enter the conveyor means depending on the time of insertion relative to the position of the conveyor means, and on the time taken and path followed by the coin in the coin entry means. If the coin does not enter the conveyor means, then it passes onto the playfield in the usual way, either directly or via an upper surface of the coin pusher. The sensor means preferably comprise an infra-red sensor or a microswitch which is actuated when a coin passes down the coin slide.

The amusement machine preferably incorporates means for randomising the amount of the bonus payout according to the time of the signal from the sensor means to the actuating means. There is also preferably a display of the amount of the bonus payout, the display varying continuously with time and being temporarily stationary when a bonus payout is made.

Reference is now made to the accompanying drawings, in which.

Figure 2:
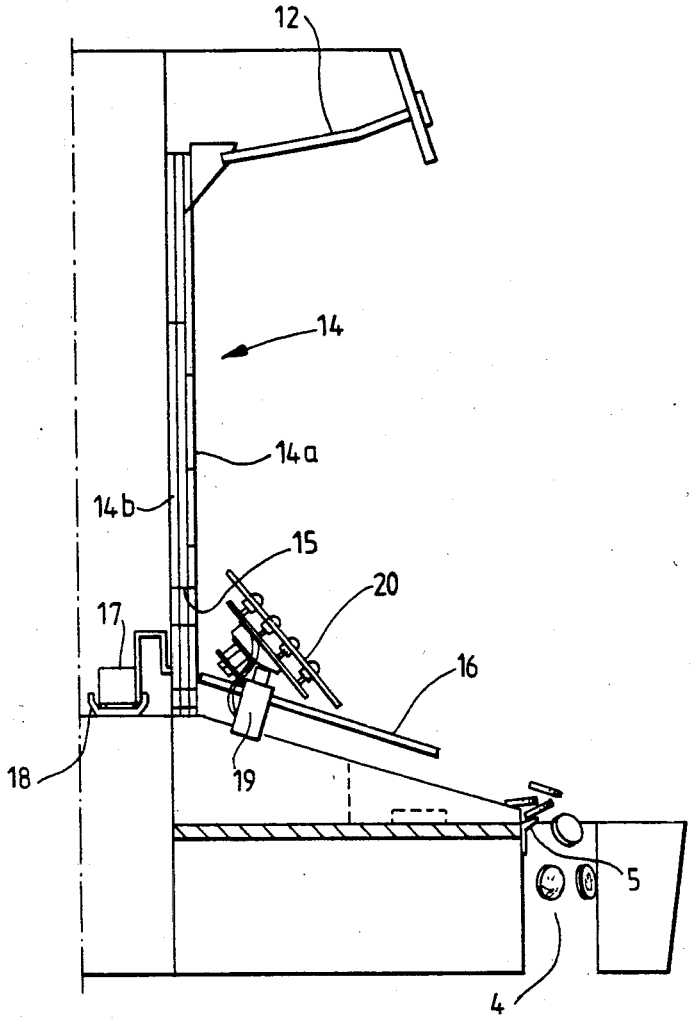
FIG. 2 is a diagrammatic side view corresponding to FIG. 1.
Figure 3:
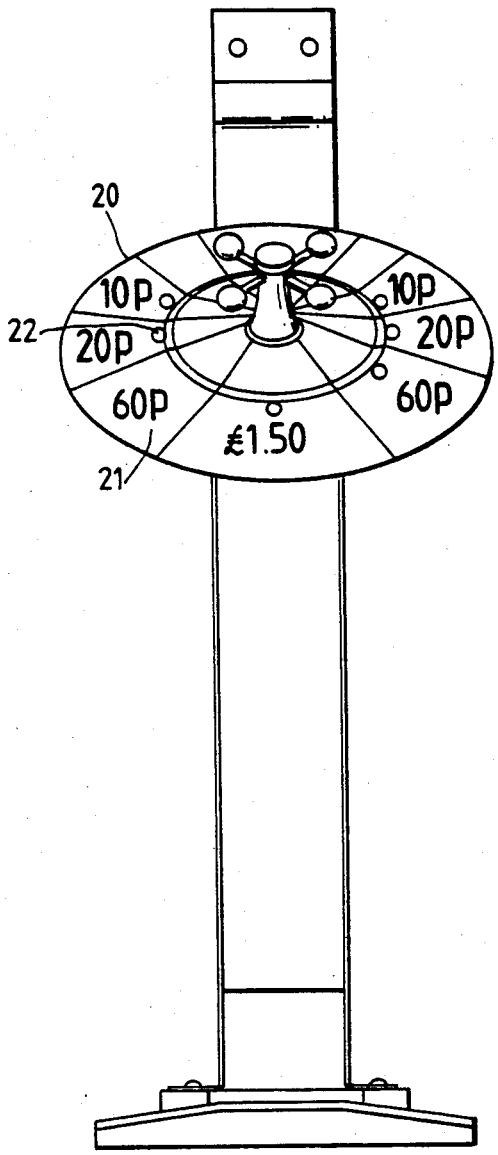
FIG. 3 is an enlarged view of the coin slide showing the "roulette wheel" display.

As shown in the drawings, the amusement machine includes a playfield having a flat, horizontal upper surface 1. A large number of coins 2 is distributed over this surface. The playfield surface 1 is rectangular in shape and has a front edge 3 over which the coins may be pushed. When a coin falls over the front edge 3, it passes into a win chute 4 and hence into a pay cup from which it may be recovered by the user of the machine. As shown in FIG. 2, the edge 3 may be extended by a slightly raised flange 5 which enables the coins to overlap and overhang the edge to a considerable extent, before they are pushed off. The side boundaries of the playfield are closed to the coins by vertical walls except for a "lose hole" 6 in each wall. Coins may be pushed through the lose holes in the same manner as they are pushed over the edge 3. However, when coins pass through the lose holes, they fall through a lose chute (not shown) and are retained in the machine. The size of the lose holes can be adjusted so as to increase or decrease the chances of a user of the machine making a nett gain.

A coin pusher 7 is arranged to pass backwards and forwards over part of the playfield surface 1. The coin pusher is driven by suitable gearing from a motor (not shown). The reciprocating motion of the coin pusher 7 is perpendicular to the edge 3 and parallel to the playfield surface 1. The lower leading edge of the coin pusher 7 has downward projections 8 which sweep across the surface of the playfield and, in the forward motion, urge the coins towards the edge 3. Close to the upper surface 9 of the coin pusher there is arranged a fixed wall 10. Coins which fall on the surface 9 in front of the wall 10 will tend to be swept forward during the backward stroke of the coin pusher 7. Eventually, during such backward stroke, some coins will be pushed off the front of the surface 9 onto the playfield surface 1. Coins which fall onto the surface 9 behind the wall 10 will tend to be retained in the machine.

A coin passage in the machine comprises a conventional coin slot 11 and a coin slide 12, in which the coin is supported by underhanging flanges, whereby undersize coins will fall straight into the cash box of the machine and be retained, rather than passing into the machine proper. The coin then enters a coin slalom 13 which constrains the falling coins to a zig-zag path. Finally, the coins pass through a pin-Perspex member 14 (Perspex is a Trade Mark), which comprises front and rear Perspex sheets, **14*a* and 14*b* respectively, separated by a gap slightly greater than the thickenss of the coins to be used. Engaged between the walls 14*a* and 14*b* is a pattern of metallic pins 15, such that coins falling through the pin-Perspex member bounce off the pins in a more or less random manner so that the user cannot predict exactly how a coin will fall. Coins which have passed through the pin-Perspex member 14 may fall directly onto the playfield surface 1 (if the coin pusher 7 has just completed its backward stroke at the appropriate time) or they may fall onto the surface 9, which may cause some coins eventually to be pushed onto the playfield surface 1. Clearly, the more coins which eventually find their way onto the playfield surface 1, the greater will be the chance of coins being pushed off the edge 3**.

The machine comprises coin conveyor means in the form of a reciprocating coin slide 16. This coin slide passes downwardly from the lower part of the pin-Perspex member 14 to a location above and close to the edge 3 of the playfield surface. The slide is wide enough and the slope is sufficient to enable coins easily to slide down it face down.

Figure 1:
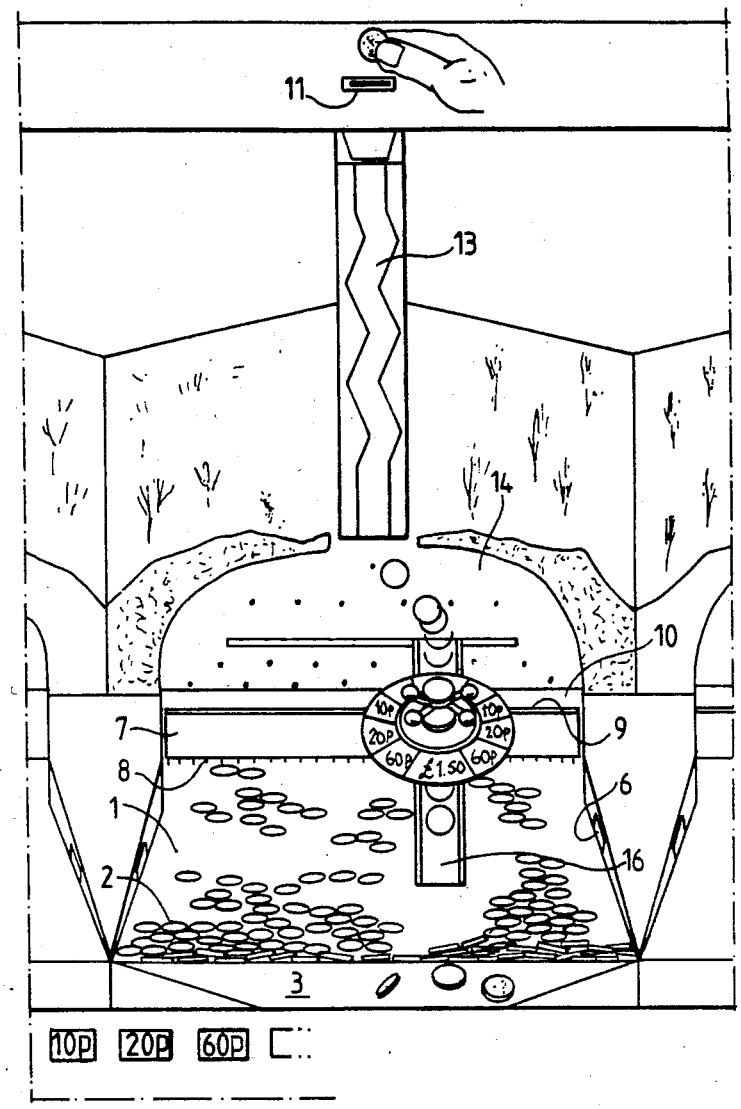
FIG. 1 is a diagrammatic front view of part of an amusement machine according to a preferred embodiment of the invention.

The slide 16 reciprocates in a direction perpendicular to the reciprocating motion of the coin pusher 7, i.e. the slide reciprocates from left to right and back as viewed in FIG. 1. The upper end of the slide 16 is joined to a square section member 17 which can slide in a horizontal channel 18 which is fixed behind the pin-Perspex member 14. The member 17 is connected to suitable gearing (not shown) which ensures this reciprocating motion, and is preferably driven by the same motor which drives the coin pusher.

Thus, a coin inserted by a user of the machine may follow a number of different paths. It may fall through the pin-Perspex member onto the playfield surface 1 either directly or via the surface 9. There is also a chance that it will fall through the pin-Perspex member onto the slide 16, and thus bypass the surfaces 9 and 1. It is essentially a random matter whether or not a coin passes down the slide 16. The downward fall of coins is delayed to a certain extent by the coin slalom 13 and in particular by the pin-Perspex member 14, and the latter also ensures that coins may pass anywhere along the path followed by the upper end of the slide 16. If the presence of the coin on this path coincides with the presence of the upper end of the slide 16, then the coin will fall down the slide. Otherwise, the coin will fall onto the surfaces 9 or 1. Although the user may try to time his entry of the coin in the coin slot, the delay in the fall of the coin caused by the slalom and pin-Perspex make the entry of a coin onto the coin slide 16 an essentially random matter.

An inra-red sensor 19 is mounted on the coin slide 16 and is actuated when a coin passes down the slide. A signal from the sensor causes actuating means (not shown) to release a bonus payment of coins into the pay cup. The coins for this bonus payment are released from a hopper which is self-filling via coins from the lose hole.

The machine incorporates means for randomizing the amount of the bonus payment according to the time of the signal from the sensor to the actuating means. A circular display 20 resembling a roulette wheel is mounted on the coin slide 16. The display is divided into sectors 21 representing bonus payments of different values and each having a corresponding LED light 22. These lights are lit in continuous sequence, to represent a ball passing around the roulette wheel. There may be a similar linear display 23 on the front of the machine. The continuous sequence is temporarily interrupted when the sensor indicates a coin on the coin slide 16. The bonus payout corresponds to that which is indicated by the light 22 then illuminated on the roulette wheel, and that light remains illuminated while the payout is made. The sequence of lights then recommences.

Thus, in comparison with conventional coin pusher machines, the present machine has the additional feature that if the user is sufficiently lucky to get his coin onto the coin slide 16, then he will receive a bonus payout which will vary depending on the sector of the roulette wheel display which is illuminated at the time.

It will be apparent that certain variations are possible in the above embodiment whilst still within the overall scope of the invention. For example, there may be more than one coin slide 16. These may all reciprocate as described above, or they may be fixed. Instead of the coin slide 16 reciprocating, it may swivel about a point close to its upper end. In this case, the lower end of the slide 16 would describe an arc of a circle intersecting the edge 3. The coin slide 16 may be adapted to allow coins to run down it on their edge, rather than on their faces as described above. There may also be more than one coin pusher. These may be arranged side by side or even one on top of another to provide a range of surfaces over which coins may be pushed.

What is claimed is:

1. An amusement machine comprising a playfield having a flat, horizontal upper surface, adapted in use to support coins; a coin pusher which, in use periodically sweeps across part of the playfield surface so as to disturb coins distributed thereon, whereby some coins may be pushed over at least one edge of the playfield surface into a win chute leading to a pay cup from which coins may be recovered by the user of the machine; a coin passage through which the user can introduce additional coins onto the playfield surface to increase the chance of coins being pushed over the said edge; coin conveyor means to convey some coins, introduced by the user, directly from the coin passage to a location above and close to the said edge of the playfield; means for randomly selecting coins introduced by the user to pass from the coin passage into the coin conveyor means; sensor means which detect the passage of a coin in the coin conveyor means; and actuating means which, in response to a signal from the sensor means, release a bonus payout of coins into the pay cup, and means for randomizing the amount of the bonus payout according to the time of the signal from the sensor means to the actuating means.

2. An amusement machine as claimed in claim 1, wherein the coin conveyor means comprises a sloping coin slide able to reciprocate transversely relative to the coin pusher, so that its entry is always in communication with the coin passage and its exit is always close to the edge of the playfield, whereby a coin inserted by the user may enter the conveyor means depending on the time of insertion relative to the position of the conveyor means, and on the time taken and path followed by the coin in the coin passage.

3. An amusement machine as claimed in claim 2, wherein the sensor means comprise an infra-red sensor or a microswitch which is actuated when a coin passes down the coin slide.

4. An amusement machine as claimed in claim 1, incorporating a display of the amount of the bonus payout, the display varying continuously with time and being temporarily stationary when a bonus payout is made.

* * * * *